US006328666B1

(12) United States Patent
Manory

(10) Patent No.: US 6,328,666 B1
(45) Date of Patent: Dec. 11, 2001

(54) TOTALLY ADJUSTABLE HOCKEY STICK WEIGHT

(75) Inventor: Marc A. Manory, 2346 Royal Ave. #8, Simi Valley, CA (US) 93064

(73) Assignee: Marc A. Manory, Simi Valley, CA (US)

( * ) Notice: Subject to any disclaimer, the term of this patent is extended or adjusted under 35 U.S.C. 154(b) by 0 days.

(21) Appl. No.: 09/317,696

(22) Filed: May 24, 1999

Related U.S. Application Data

(60) Provisional application No. 60/086,875, filed on May 27, 1998.

(51) Int. Cl.[7] ..... A63B 69/00
(52) U.S. Cl. ..... 473/437; 473/446
(58) Field of Search ..... 473/560–563, 473/437, 446

(56) References Cited

U.S. PATENT DOCUMENTS 3,521,883 * 7/1970 Hamilton ..... 473/437
3,834,697 * 9/1974 McNamara, Jr. et al. ..... 473/437
4,364,560 * 12/1982 Gemmel ..... 473/437
5,484,146 * 1/1996 Loschiavo ..... 473/437
5,520,386 * 5/1996 Sasko ..... 473/563
5,749,814 * 5/1998 Chen ..... 473/437

FOREIGN PATENT DOCUMENTS

936553 * 11/1973 (CA) ..... 473/FOR 189

* cited by examiner

*Primary Examiner*—Mark S. Graham
(74) *Attorney, Agent, or Firm*—George V. Manory

(57) ABSTRACT

The totally adjustable hockey stick weight (known commercially as 'THE ORIGINAL STICK WEIGHT'®) is a training device designed for quick attachment to and removal from hockey sticks (ice or roller). It is used exclusively for practice, warm-ups, or training. The totally adjustable hockey stick weight is manufactured from aircraft aluminum: 6061/6063 T-5 or any comparable grades thereof. The aluminum itself can be machined from raw billets or drawn through a die into the specifically designed shapes of the wide variety of the adjustable hockey stick weight(s) themselves holding their controlled, fixed dimensions. The totally adjustable hockey stick weight comprises of two main components: a main body, and a face plate. It is manufactured (as mentioned previously) in a variety of sizes, shapes, and weights. In addition, all the various shapes and sizes adhere to the integrity and configuration of the original design. The face plates with their standard 'V'-groove are held in place against the 'U'-shaped main body through the use of two thumb screws.

15 Claims, 13 Drawing Sheets

Fig. 4
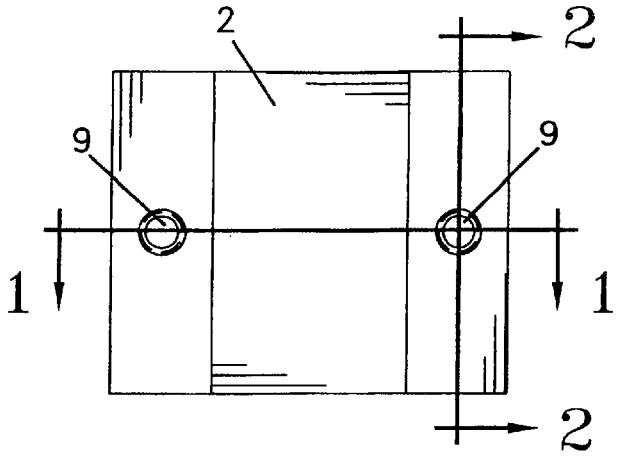
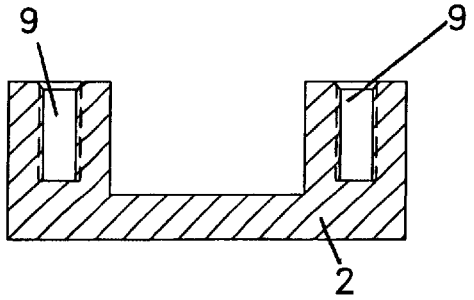
Fig. 4a
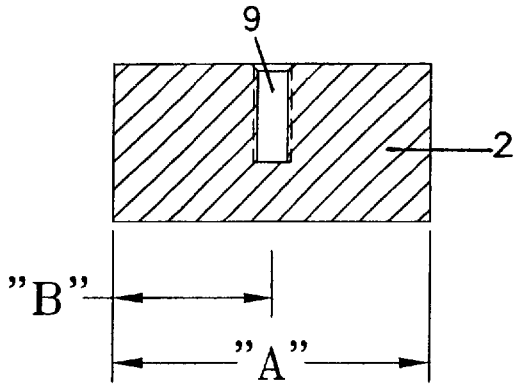
Fig. 4b
| FIGURE | NAME | "A" | "B" | WEIGHT |
|---|---|---|---|---|
| 2 (STANDARD) | OSW SENIOR | 2.00 | 1.00 | 6 OZ |
| 2-MM (OPTIONAL) | OSW SENIOR MINI MAGNUM | 3.00 | 1.50 | 9 OZ |
| 2-M (OPTIONAL) | OSW SENIOR MAGNUM | 4.00 | 2.00 | 12 OZ |

Fig. 5
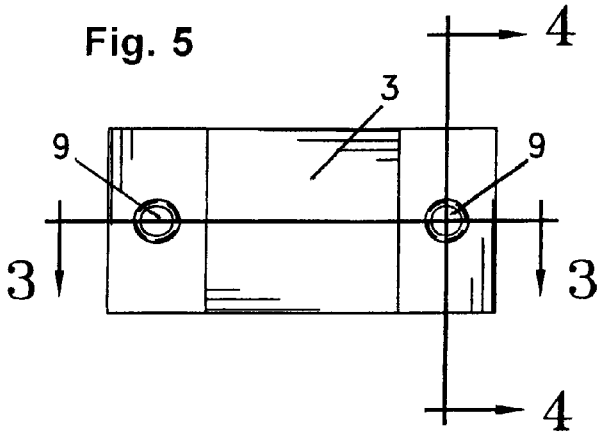
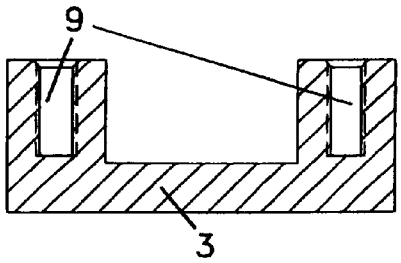
Fig. 5a
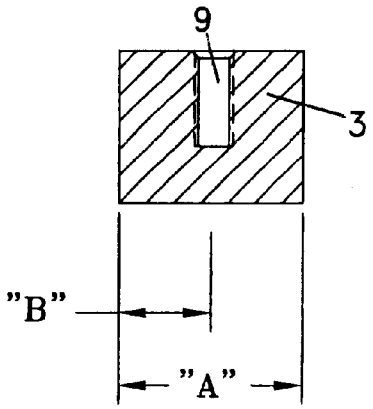
Fig. 5b
| FIGURE | NAME | "A" | "B" | WEIGHT |
|---|---|---|---|---|
| 3 (STANDARD) | OSW JUNIOR | 1.20 | .60 | 4 OZ |
| 3-MM (OPTIONAL) | OSW JUNIOR MINI MAGNUM | 1.80 | .90 | 6 OZ |
| 3-M (OPTIONAL) | OSW JUNIOR MAGNUM | 2.40 | 1.20 | 8 OZ |

"LATERAL STYLE"

"HORIZONTAL STYLE"

| FIGURE | STYLE | MATES WITH | "A" | "B" |
|---|---|---|---|---|
| 5-L | LATERAL | OSW™ SENIOR | 2.00 | 1.00 |
| 5-LMM | LATERAL | OSW™ SENIOR MINI MAGNUM | 3.00 | 1.50 |
| 5-LM | LATERAL | OSW™ SENIOR MAGNUM | 4.00 | 2.00 |
| 5-H | HORIZONTAL | OSW™ SENIOR | 2.00 | 1.00 |
| 5-HMM | HORIZONTAL | OSW™ SENIOR MINI MAGNUM | 3.00 | 1.50 |
| 5-HM | HORIZONTAL | OSW™ SENIOR MAGNUM | 4.00 | 2.00 |

"LATERAL STYLE"

"HORIZONTAL STYLE"

| FIGURE | STYLE | MATES WITH | "A" | "B" |
|---|---|---|---|---|
| 6-L | LATERAL | OSW™ JUNIOR | 1.20 | .60 |
| 6-LMM | LATERAL | OSW™ JUNIOR MINI MAGNUM | 1.80 | .90 |
| 6-LM | LATERAL | OSW™ JUNIOR MAGNUM | 2.40 | 1.20 |
| 6-H | HORIZONTAL | OSW™ JUNIOR | 1.20 | .60 |
| 6-HMM | HORIZONTAL | OSW™ JUNIOR MINI MAGNUM | 1.80 | .90 |
| 6-HM | HORIZONTAL | OSW™ JUNIOR MAGNUM | 2.40 | 1.20 |

| FIGURE | "A" | "B" | WEIGHT |
|---|---|---|---|
| 4 | 2 | 1 | 6 OZ |
| 4-GMM | 3 | 1.5 | 9 OZ |
| 4-GM | 4 | 2 | 12 OZ |

TOTALLY ADJUSTABLE HOCKEY STICK WEIGHT

CROSS-REFERENCE TO RELATED APPLICATIONS

P.P.A. File No. 60/086,875 Dated May 27, 1998.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention, known as the totally adjustable hockey stick weight, relates to a balanced yet adjustable training device to be used primarily for the sports of ice and roller hockey. It correctly enhances and develops all the specific muscle groups that are required to efficiently and effectively hone all aspects of puck control: e.g., stick handle, passing, and shooting.

2. Description of Related and/or Prior Art

It is well understood that strength training can significantly increase one's performance in sports; and it is the totally adjustable hockey stick weight that masterfully accomplishes this function! Previous types of hockey stick weights and/or their related weighted training devices: e.g. (U.S. Pat. Nos. 5,520,386 and 5,127,649 both to Sasko (1994); 5,484146 to Loschiavo (1996); 4,563,753 to Scarry (1987); 4,364,560 to Gemmel (1982); and 3,834,697 to McNamara Jr. and Baum (1974), were either too heavy, too light, or too cumbersome to be installed quickly on and/or removed from a hockey stick. This drastically hampered the effectiveness needed to development the basic and advanced stick handling skills required to play the games of ice and/or roller hockey. These previous devices not only placed too much weight at inappropriate areas of the hockey stick they were also too awkward to use during any type of aggressive practice. These problems are/were not advantageous to the development of the specific muscle groups required to successfully play the game of ice and/or roller hockey; Specifically the stick handling, the passing, and the shooting aspects of the game.

BRIEF SUMMARY OF THE INVENTION

The totally adjustable hockey stick weight (referencing the various models of the senior/v-i & v-ii, junior, and goalie) serves to add the exact weight in a variable resistance form (in both location and the actual ability to adjust the amount of weight {only the senior/v-i}) directly to the most advantageous location of the hockey stick shaft or handle. The totally adjustable hockey stick weight additionally optimizes the weight training by creating a specific workout related to the training exercises that are being performed.

Training with the totally adjustable hockey stick weight strengthens those specific muscle groups that are required to master the skills of puck control, stick handling, and shooting.

No product, such as the totally adjustable hockey stick weight, has ever been designed with the ability to effectively and efficiently out perform the actual tasks for which it was intended!

BRIEF DESCRIPTION OF THE SEVERAL VIEWS OF THE DRAWING(S)

FIG. 1 is a view of a hockey stick with the stick weight attached at its recommended location along the shaft.

FIG. 1*a* is an angled view of the OSW as viewed along the line A—A.

FIG. 4 is a sectional view of the Senior/v-ii 'U'-shaped main body, its various dimensions, without the add-a-weight holes.

FIG. 4*a* is a sectional view of the OSW as viewed along the line 1—1.

FIG. 4*b* is a sectional view of the OSW as viewed along the line 2—2.

FIG. 5 is a sectional view of the Junior 'U'-shaped main body.

FIG. 5*a* is a sectional view of the OSW as viewed along the line 3—3.

FIG. 5*b* is a sectional view of the OSW as viewed along the line 4—4.

Figure 6C:
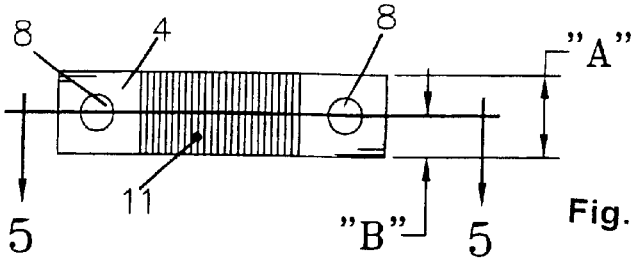
Figure 6D:
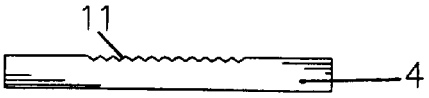
Figure 6A:
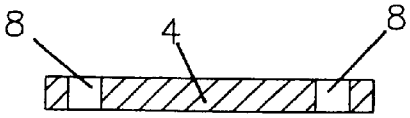

FIG. 6*a* is a sectional view of the Senior OSW face plate as viewed along the line 5—5.

Figure 6B:
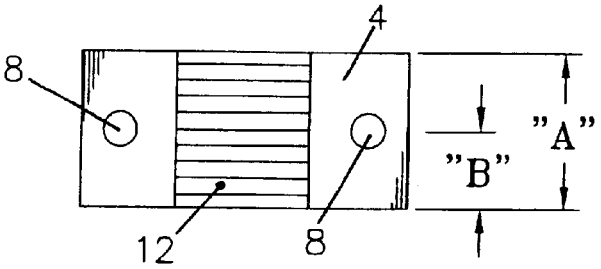

FIG. 6*b* is a full view of the Senior OSW face plate, from the bottom (inside), with horizontal 'V'-grooves.

FIG. 6*c* is a full view of the Senior OSW face plate, from the bottom (inside), with lateral 'V'-grooves.

FIG. 6*d* is a full view of the Senior OSW face plate, from the end, with lateral 'V'-shaped grooves.

Figure 7A:
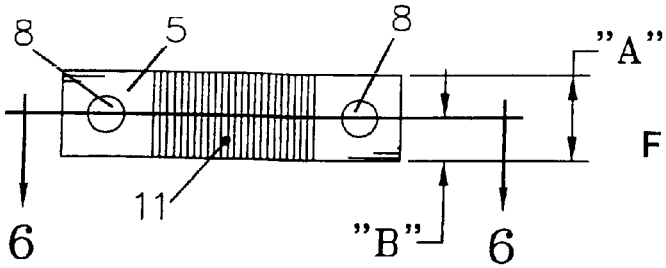

FIG. 7*a* is a full view of the Junior OSW face plate, from the bottom (inside), with lateral 'V'-grooves.

Figure 7B:
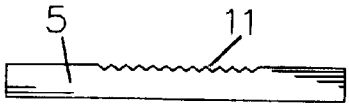

FIG. 7*b* is a full view of the Junior OSW face plate, from the end, with lateral 'V'-grooves.

Figure 7C:
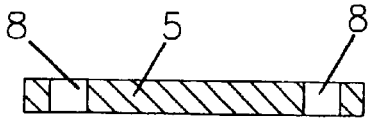

FIG. 7*c* is a sectional view of the Junior OSW face plate as viewed along the line 6—6.

Figure 7D:
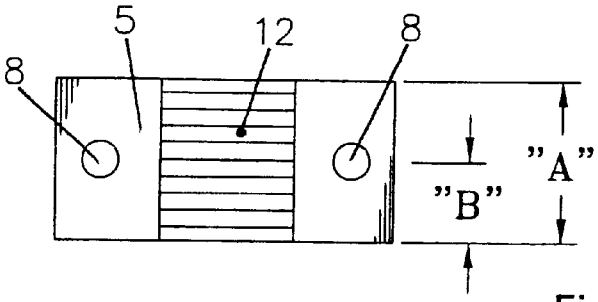

FIG. 7*d* is a full view of the Junior OSW face plate, from the bottom (inside), with horizontal 'V'-grooves.

Figure 8:
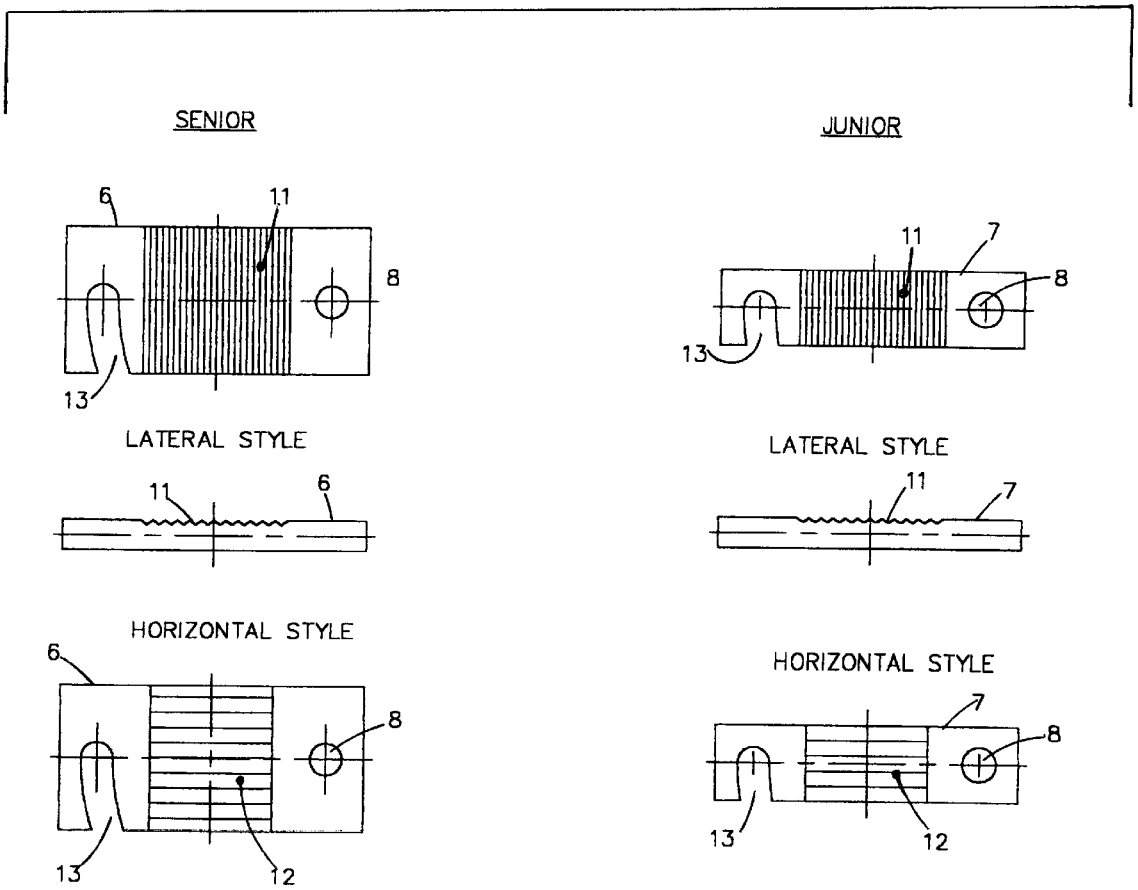

FIG. 8 is a sectional view of the Quick Release face plate: all the various Junior and Senior face plate dimensions apply.

Figure 9:
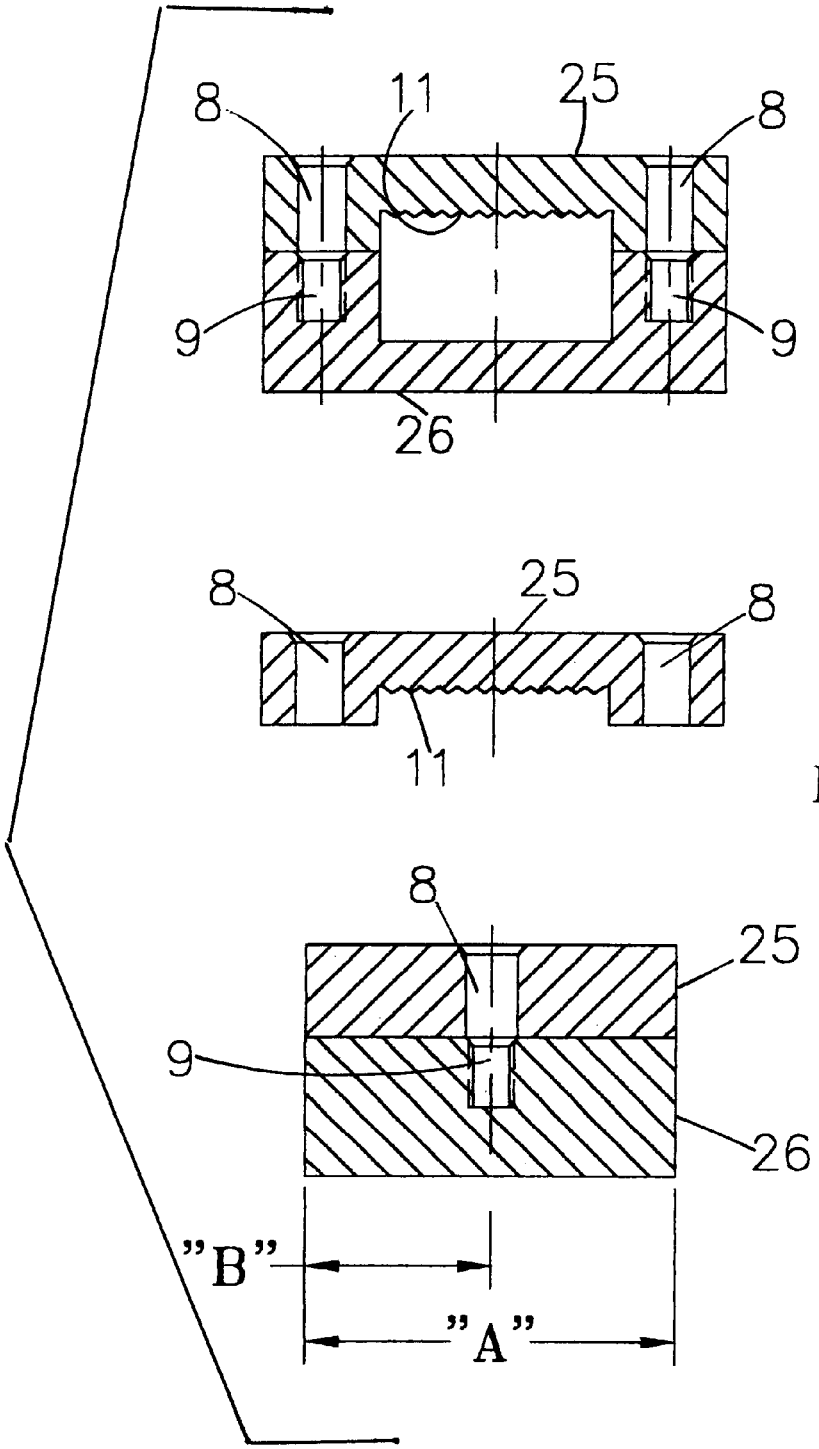

FIG. 9 is a sectional view of the Goalie 'U'-shaped main body and its various dimensions.

Figure 10:
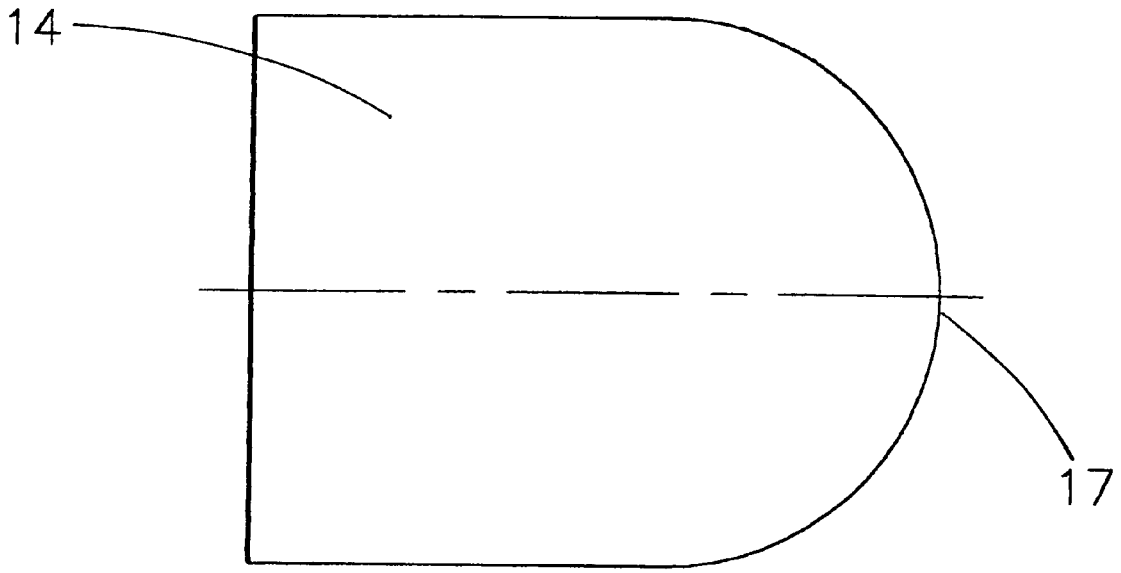

FIG. 10 is a side view of the ½ ounce, .500" [½] diameter stainless steel add-a-weight.

Figure 11:
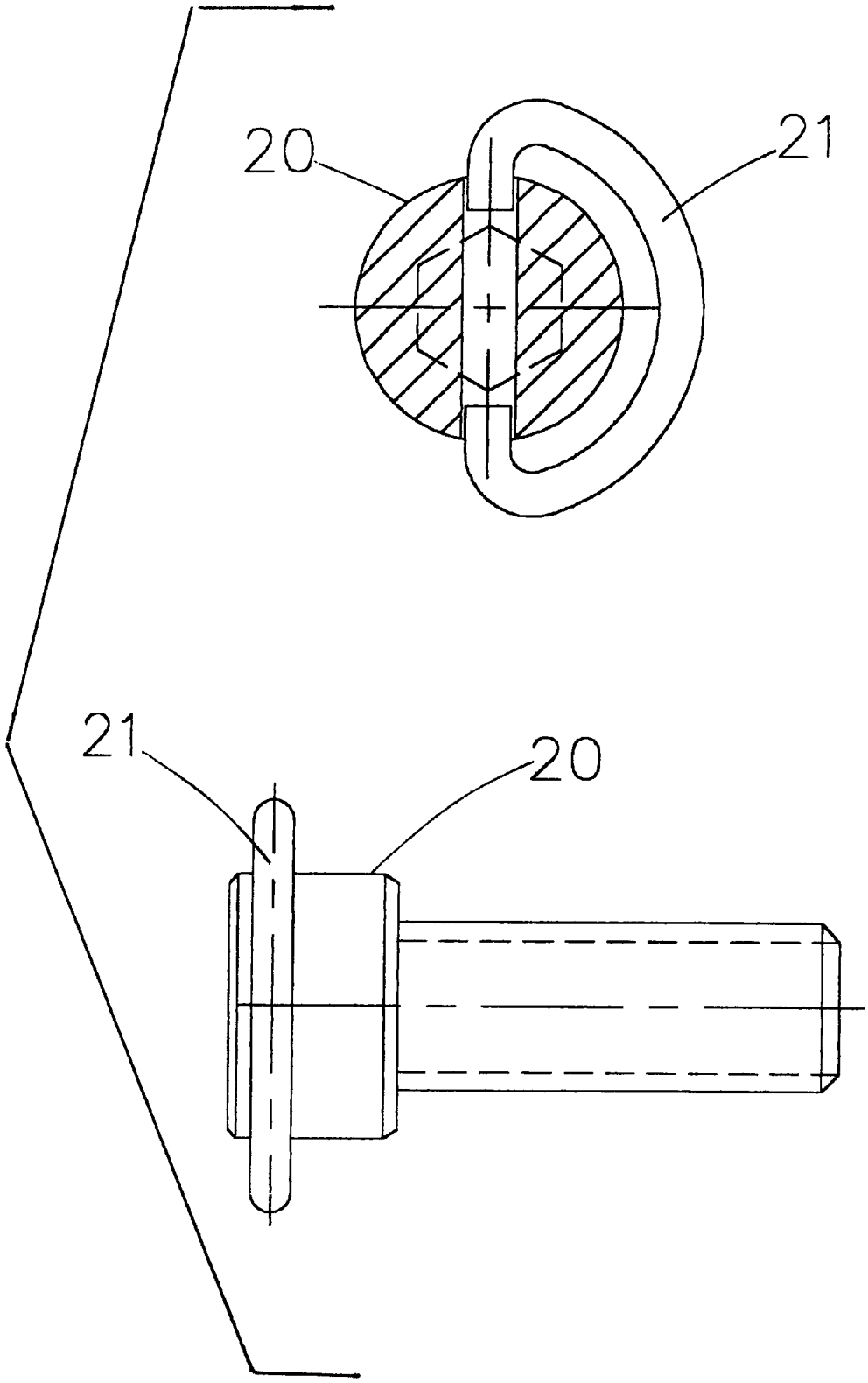

FIG. 11 is a side view of the ¼-20 hex head thumb screw.

Figure 12:
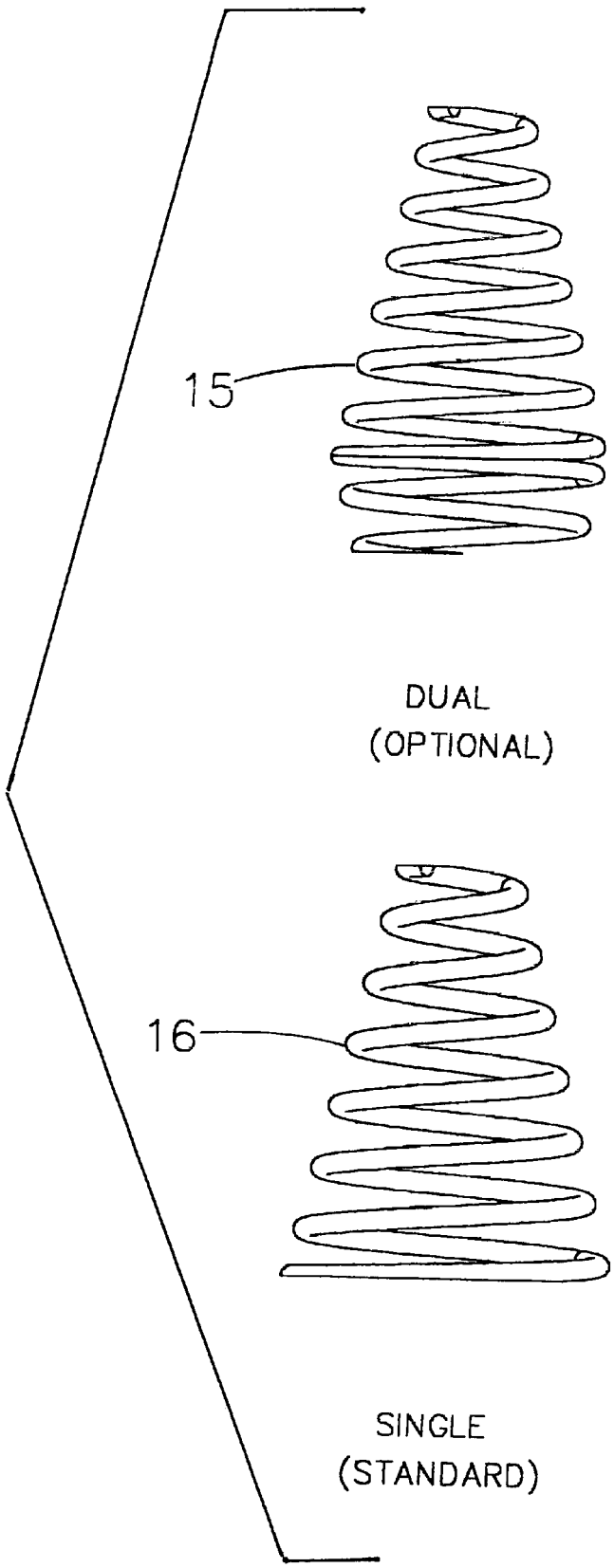

FIG. 12 are side views of the single (standard) and dual [optional] conical spring.

Figure 13:
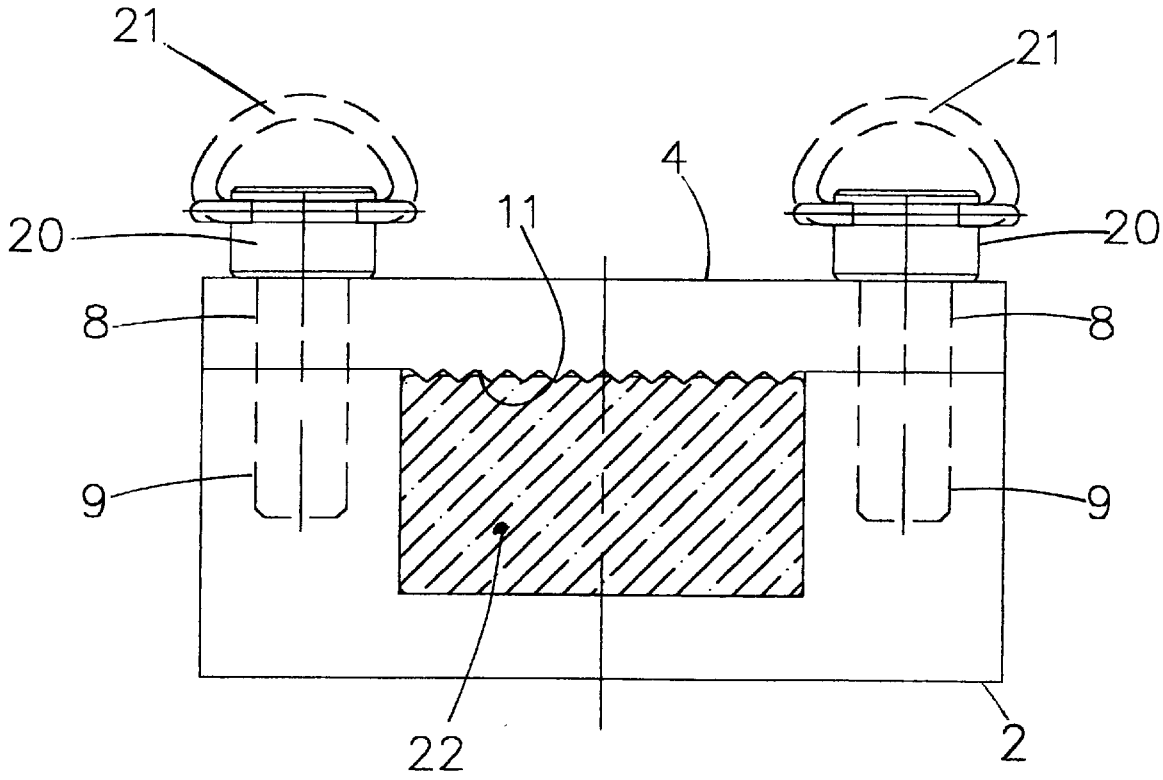

FIG. 13 is the cross sectional view of the mounted stick weight.

DETAILED DESCRIPTION OF THE INVENTION

The Totally Adjustable Hockey Stick Weight (generically referred as The Original Stick Weight) is a device that comprises of two sections: a U-shaped main body #'s 1, 2, and 3, and a custom machined, 'V'-grooved face plate #'s 4, 5, 6, and 7. The face plate is secured to the main body (in every application) by means of two ¼-20 hex head thumb screws FIG. 11 #20. These two thumb screws 20 pass through two threadless 0.265" (inch) diameter mounting holes 8 in their respective face plates #'s 4, 5, 6, & 7 and screw into the two ¼-20 tapped (threaded) holes 9 that are machined into the vertical plane of the 'U'-shaped main body's side walls 18. In all, there are ten configured adjustable hockey stick weights: the main bodies FIGS. 3, 4, 5, & 9, and their respective face plates FIGS. 6, 7, & 8. This detailed description of the invention shall describe the basic (senior/v-i FIG. 3 #1) hockey stick weight with add-a-weight holes 10. For reference purposes: only the senior/v-i FIG. 3 #1 has the 0.515" (inch) holes 10 for the four add-a-weights FIG. 10 #17. All other designs of the hockey stick weight are simply extended or reduced versions of the senior/v-i model FIG. 3 #1, less the add-a-weight holes 10: e.g., The junior, FIG. 5; the senior/v-ii, FIG. 4; the goalie, FIG. 9.

The only significant difference between all models of the totally adjustable hockey stick weight is their width. In addition, by varying only the width, the optional adjustable hockey stick weights referred to as the magnum & the mini-magnum are created. All of the other key elements, characteristics, and dimensions are kept in tact.

Figure 3:
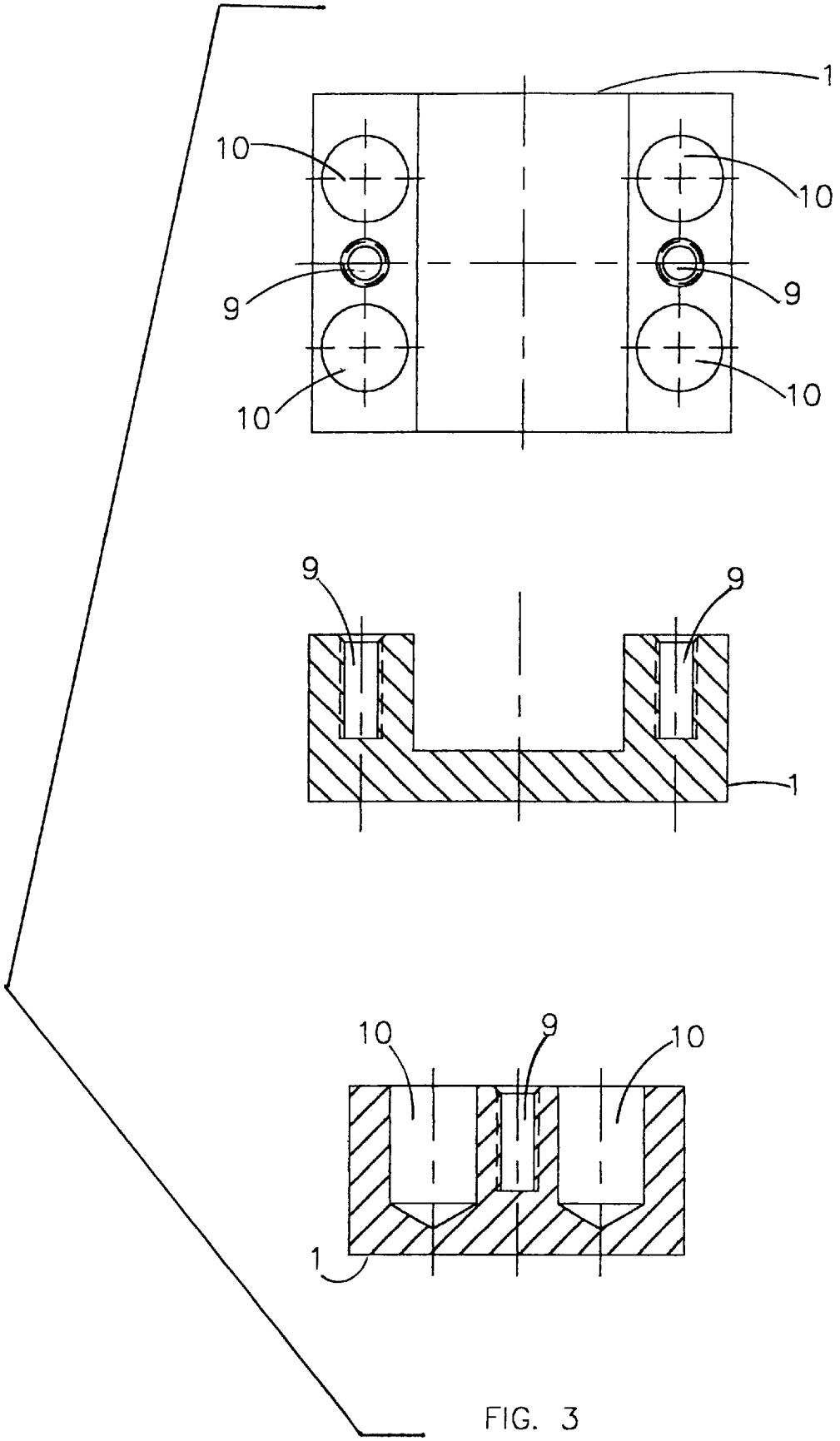
FIG. 3 is a sectional view of the Senior/vi 'U'-shaped main body with add-a-weight holes.

The totally adjustable hockey stick weight, senior/v-i FIG. 3 #1, has a total of six holes (three per side) that are machined vertically into the sidewalls 18 of the 'U'-shaped main body. The physical pattern of the three holes per side is symmetrical. Of the three holes per side, the two holes that sit closest to the outside edge are the large, untapped (threadless) 0.515' (inch) diameter holes 10 that are designed to accommodate the 0.500" (inch) diameter stainless steel add-a-weights FIG. 10 #14, and their respective single FIG. 12 #16 (standard) or dual FIG. 12 #15 (optional) conical springs. The center holes 9 are singularly tapped (¼-20-threaded) holes that sit dimensionally in the center between the two untapped add-a-weight holes 10. As previously stated, these add-a-weight holes 10 are a feature of the senior/v-i hockey stick weight only FIG. 3 #1; no other adjustable hockey stick weights (senior/v-ii, junior, or goalie) have this feature!

The two, single ¼-20 threaded holes 9 are designed to accommodate two ¼-20 thumb screws FIG. 11 #20. These two ¼-20 thumb screws hold all the various face plates FIGS. 6, 7, & 8, #'s 4, 5, 6, & 7 secure to their respective main bodies. All face plates FIGS. 6, 7, & 8, #'s 4, 5, 6, & 7 have three basic dimensions: a width, a length, and a thickness. Two of these dimensions, the length and the thickness, remain constant. The width varies depending on the specific main body that that face plate is related to; additionally, as previously mentioned, there is a unique 'V'-groove surface centrally located on each of the face plate's inner surface.

This 'V'-groove comes in two configurations: a lateral 11 (standard), or horizontal 12 (optional). The lateral 'V'-groove 11 is created as ingots of aluminum are (s)melted then forced through a steel die. This process is referred to as being drawn, formed, forged, or extruded. The horizontal 'V'-groove 12 is actually machined into the face plate as the face plate itself is being machined from an aluminum plate or billet. The location of the face plate's 'V'-groove was specifically designed so that it is centrally located directly over the opening of the 'U' 19 in the main body. The lateral 11 (standard) 'V'-grooves run parallel to the opening of the 'U' 19 section on the main body: from one side of the open 'U' 19 to the other. The horizontal 12 (optional) 'V'-grooves run perpendicular to the 'U'-shaped section 19 of the main body: from one of the ¼-20 mounting holes 9 to the other.

The quick release face plates FIG. 8, #'s 6 & 7 have an additional characteristic that is unique to this face plate alone. It has a 0.250" (¼ inch) curve/arc 13 that is machined into it. This curve/arc 13 starts at the lower edge of one (and only one) of the face plate's two threadless 0.265" (inch) diameter mounting holes 8. It is machined in what would be considered a downward direction as well as being machined in an inward direction at a 1.879" radius. This inward direction is critical. This radius (curve/arc) 13 creates the perfect opening so that neither of the two ¼-20 (inch) thumb screws FIG. 11 #20 have to be removed from the adjustable hockey stick weight in order to adjust said weight along, apply it to, or remove from the hockey stick shaft 22: simplifying the entire adjustment processes. Once the adjustable hockey stick weight has been attached to the hockey stick shaft 22, the thumb screws 20 then only need to be loosened or tightened for additional adjustment purposes. When the standard face plates 4 or 5 are used, the removal of only one of the ¼-20 thumb screws 20 is required for installation onto the hockey stick shaft 22.

Once the two ¼-20 thumb screws 20 have been screwed into their respective ¼-20 inch threaded holes 9 in the main body, the 'V'-groove 11 or 12 now becomes the acting force that actually holds the adjustable hockey stick weight in place along the hockey stick shaft 22.

Moreover, because of the adjustable hockey stick weights' unique design, the hockey stick weight can be rapidly adjusted to any location along the plane of the hockey stick shaft 22 without having to remove the face plate. Thus, the need for tape or Velcro is not required: making the adjustable hockey stick weight a totally mechanical device additionally, the 'V'-grooves, 11 and/or 12 will not scar the hockey stick shaft 22 because of the thick 3 mil (0.003"), durable powder coating, which covers the entire hockey stick weight.

Powder coating is the finest painting technology available today. It is more durable, more chip resistant, and completely environmentally friendly. It is applied to the hockey stick weight after it has been manufactured to its physical and dimensional characteristics: whether drawn through a die or machined to completeness. The basic powder coating color used is safety yellow (Cardinal #YL01). This allows the adjustable hockey stick weight to be clearly seen as it adds to its physical and structural strength.

The ½ inch stainless steel add-a weights FIG. 10 #14 have a 0.250" (¼ inch) radius 17 on one side, and a flat surface on the other. This flat surface, or bottom of the add-a-weight 14 (when inserted into the 0.515' add-a-weight holes 10) rests on the tip of one of the two types of conical cone springs FIG. 12: either the single 16 (standard) or the dual 15 (optional) spring.

In FIG. 12, the single 16 (standard) conical cone spring has a 0.545 inch diameter at the base of the largest side of the cone shaped spring, with the tip or top of the spring being 0.150" (inches) in diameter. Its overall free length is 0.312" (inches) long with 4.5 turns, and the thickness of the spring wire is 0.035" (inches). The dual 15 (optional) conical cone spring has a 0.545 inch diameter at the center and is tapered inward in both directions. The diameters of the tips of the dual 15 cone spring are identical, but the overall length differs in this respect. One side (the traditional bottom side) is only 0.150 inch long and the other side (the traditional topside) is the same as the single cone spring: 0.312 (inches) long. The overall free length is 0.462 (inches) long with 6.5 turns, and the thickness of the spring wire is 0.028" (inches). And lastly, what makes the dual 15 spring so versatile is that it was originally designed so that the smaller end of the spring would be inserted first, but it will work regardless of which end is inserted into the FIG. 3 #10 add-a-weight holes. There are four (4) add-a-weights FIG. 10 #14 and four (4) conical springs FIG. 12 #15 or 16 that come with every adjustable hockey stick weight of the senior/v-i FIG. 3 #1 configuration.

Figure 1:
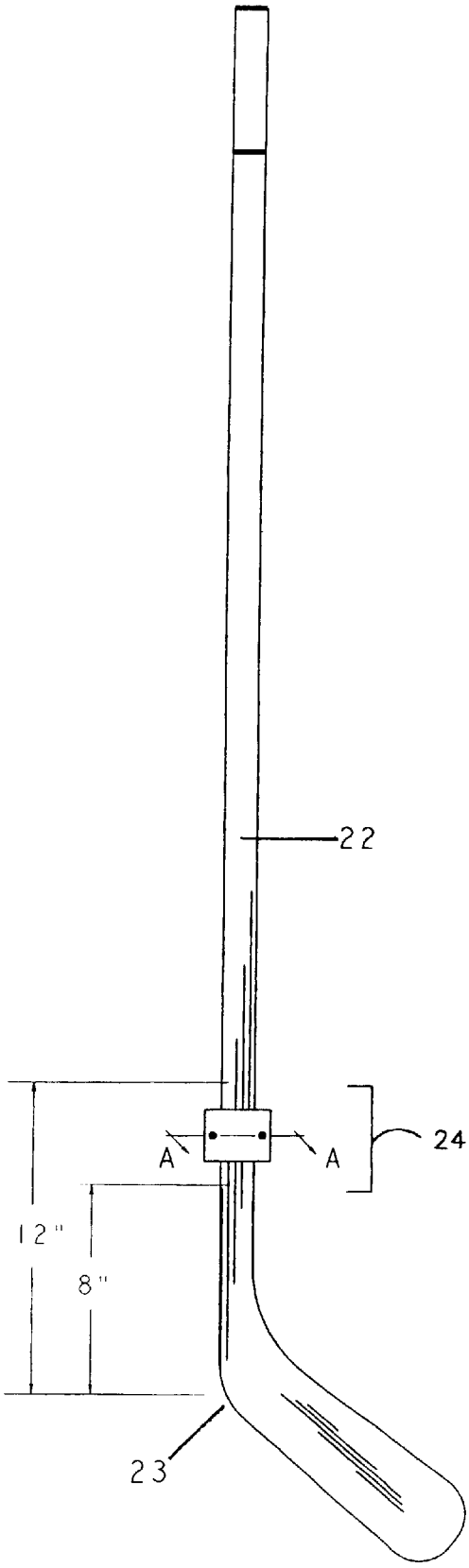
Figure 1A:
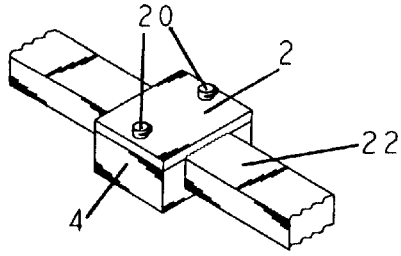
Figure 2:
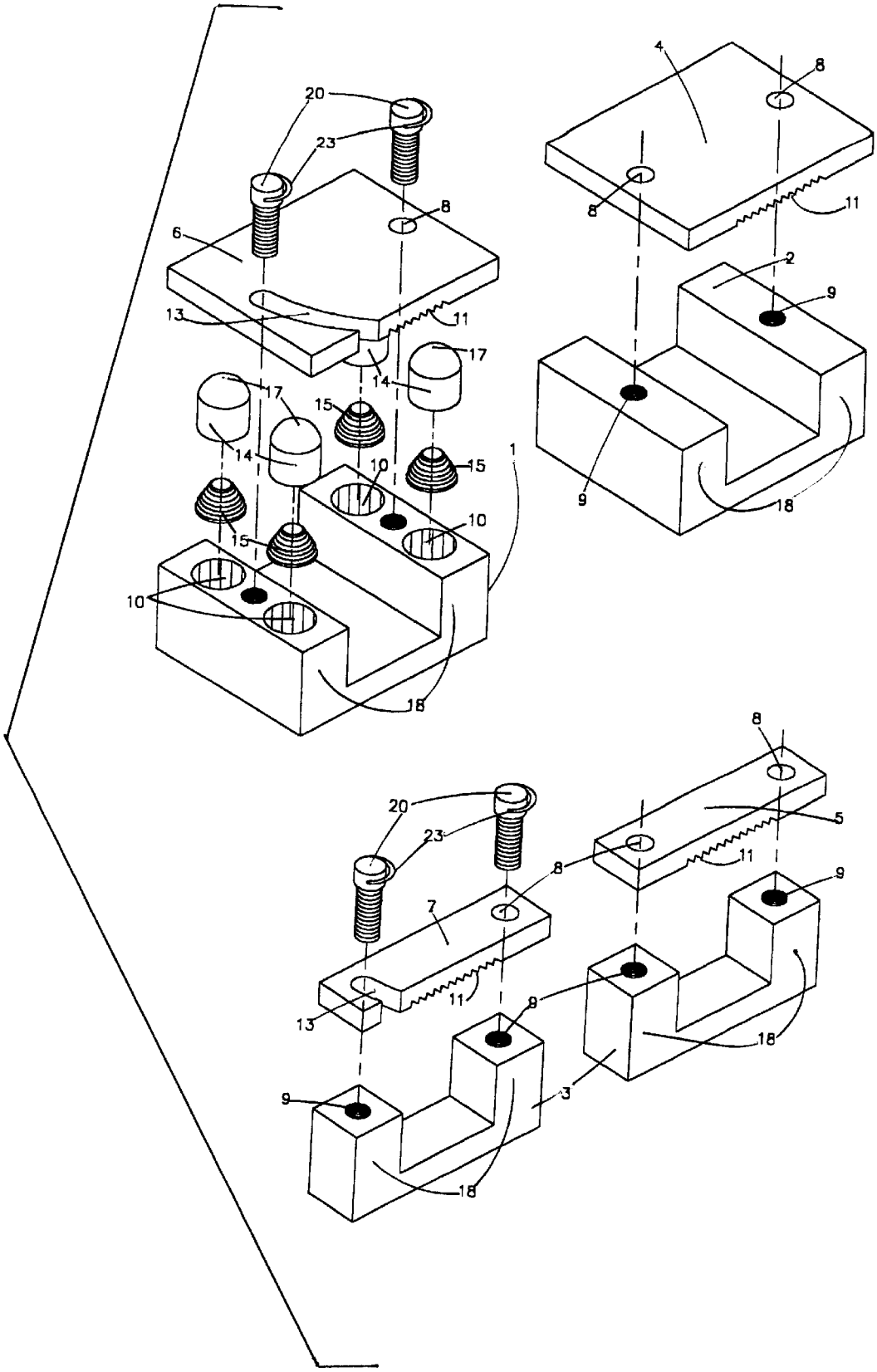
FIG. 2 is an orthographic view of the various stick weight main bodies, their related faceplates, add-a-weights, thumb screws, and conical springs.

The most favorable, practical, and functional area to use totally adjustable hockey stick weight when training for improvement in the areas of stick handling, puck control, and shot power is eight to twelve inches FIG. 1 #24 above the heel 23 of the hockey stick blade. By review of the drawings, the clarity of the totally adjustable hockey stick weight functionality will become concisely clear.

Although the detailed description contains a variety of specifications, it should not be construed as to limiting the scope (to give the user an additional advantage of weight training during practice and warm UPS by use of a weighted hockey stick) of the totally adjustable hockey stick weight, but merely to provide illustrations of the totally adjustable hockey stick weight's preferred embodiments.

What I claim as my invention is:

1. An adjustable hockey stick weight for attachment to the shaft of a hockey stick comprising:

a U-shaped main body formed of two legs and a base portion connecting said legs, said U-shaped body adapted to fittingly receive a hockey stick shaft and surround three sides thereof, said legs each comprising a threaded bore for receiving a screw;

a removable face plate attachable to said legs to close off said U-shaped body such that said weight may completely surround a hockey stick shaft, said face plate comprising a through hole at a first end and a cut-out arc at a second end;

a first screw passing through said through hole and into one of said bores and a second screw passing through said cut-out arc and into the other of said bores to fasten said weight around a hockey stick shaft;

wherein the weight may be adjusted along the shaft or removed from the shaft without completely removing said screws by loosening said screws and pivoting said face plate about said first screw.

2. The adjustable hockey stick weight of claim 1, wherein said face plate comprises V-shaped grooves adapted for bearing against a hockey stick shaft.

3. The adjustable hockey stick weight of claim 1, wherein said main body comprises at least one weight element receiving closed-end bore formed in one of said legs.

4. The adjustable hockey stick weight of claim 1, wherein said main body comprises at least one weight element receiving closed-end bore formed in both of said legs.

5. The adjustable hockey stick weight of claim 3, further including at least one weight element sized for insertion into said at least one bore.

6. The adjustable hockey stick weight of claim 4, further including at least one weight element sized for insertion into said bores.

7. The adjustable hockey stick weight of claim 3, wherein said removable face plate closes off the said at least one bore when said face plate is attached to said U-shaped main body.

8. The adjustable hockey stick weight of claim 4, wherein said removable face plate closes off the said bores when said face plate is attached to said U-shaped main body.

9. The adjustable hockey stick weight of claim 3, further including at least one spring sized for insertion into said at least one bore for bearing against a weight element.

10. The adjustable hockey stick weight of claim 4, further including at least one spring sized for insertion into said bores for bearing against a respective weight element.

11. The adjustable hockey stick weight of claim 9, wherein said at least one spring is a conically shaped coil spring.

12. The adjustable hockey stick weight of claim 10, wherein said at least one spring is a conically shaped coil spring.

13. The adjustable hockey stick weight of claim 1, wherein said screws are thumb screws.

14. The adjustable hockey stick weight of claim 1, wherein said weight is finished with a polyester powder coating.

15. The adjustable hockey stick weight of claim 14, wherein said coating is yellow.

* * * * *